US012680546B2

(12) United States Patent
Springl et al.

(10) Patent No.: US 12,680,546 B2
(45) Date of Patent: Jul. 14, 2026

(54) LIQUID SEPARATION DEVICE FOR A COMPRESSOR SYSTEM AND COMPRESSOR SYSTEM HAVING SUCH A LIQUID SEPARATION DEVICE

(71) Applicants: KNORR-BREMSE SYSTEME FÜR SCHIENENFAHRZEUGE GMBH, Munich (DE); FILTRATION GROUP GMBH, Öhringen (DE)

(72) Inventors: Cornelia Springl, Bernau am Chiemsee (DE); Thomas Kipp, Munich (DE); Elias Donat, Öhringen (DE); Jakob Rostocki, Ellhofen (DE); Steffen Gorzawski, Bad Rappenau (DE)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 0 days.

(21) Appl. No.: 18/862,391

(22) PCT Filed: Apr. 20, 2023

(86) PCT No.: PCT/EP2023/060367

§ 371 (c)(1),
(2) Date: Nov. 1, 2024

(87) PCT Pub. No.: WO2023/213558

PCT Pub. Date: Nov. 9, 2023

(65) Prior Publication Data

US 2025/0290513 A1 Sep. 18, 2025

(30) Foreign Application Priority Data

May 3, 2022 (DE) ..... 10 2022 204 354.5

(51) Int. Cl.
*F04C 29/02* (2006.01)

(52) U.S. Cl.
CPC ..... *F04C 29/026* (2013.01); *F04C 2240/30* (2013.01)

(58) Field of Classification Search
CPC ..... B01D 2267/40; B01D 45/06; B01D 46/0031; B01D 46/0043; B01D 46/12; B01D 46/62; B01D 50/20; F04C 29/026
See application file for complete search history.

(56) References Cited

U.S. PATENT DOCUMENTS 9,039,799 B2 * 5/2015 Schook ..... B01D 45/06 55/440
2003/0014951 A1 * 1/2003 Crouse ..... B01D 46/0043 55/482

(Continued)

FOREIGN PATENT DOCUMENTS

| | | | |
|---|---|---|---|
| JP | 59-130091 | U | 8/1984 |
| JP | S63198784 | A | 8/1988 |
| JP | H08159581 | A | 6/1996 |

OTHER PUBLICATIONS

International Search Report corresponding to PCT/EP2023/060367 dated Sep. 22, 2023.

(Continued)

*Primary Examiner* — Anthony Ayala Delgado
(74) *Attorney, Agent, or Firm* — Barnes & Thornburg LLP

(57) ABSTRACT

A liquid separation device for a compressor system has at least one coarse separation unit, which has at least one coarse separator and a liquid removal device; at least one fine separation unit, which has at least one fine separator and a liquid removal device; and at least one liquid removal channel which leads off a liquid from the respective liquid removal devices, wherein the at least one liquid removal channel is formed in the liquid separation device.

18 Claims, 1 Drawing Sheet

(56) References Cited

U.S. PATENT DOCUMENTS

| | | | | |
|---|---|---|---|---|
| 2004/0065110 | A1* | 4/2004 | Barratt | F25B 43/02 62/503 |
| 2005/0022551 | A1* | 2/2005 | Barratt | B01D 45/06 62/471 |
| 2013/0255308 | A1* | 10/2013 | De Larminat | F25B 43/02 62/470 |
| 2016/0375390 | A1 | 12/2016 | Steiner | |

OTHER PUBLICATIONS

Japanese Office Action corresponding to JP Patent Application No. 2024-564877 dated Apr. 13, 2026.

* cited by examiner

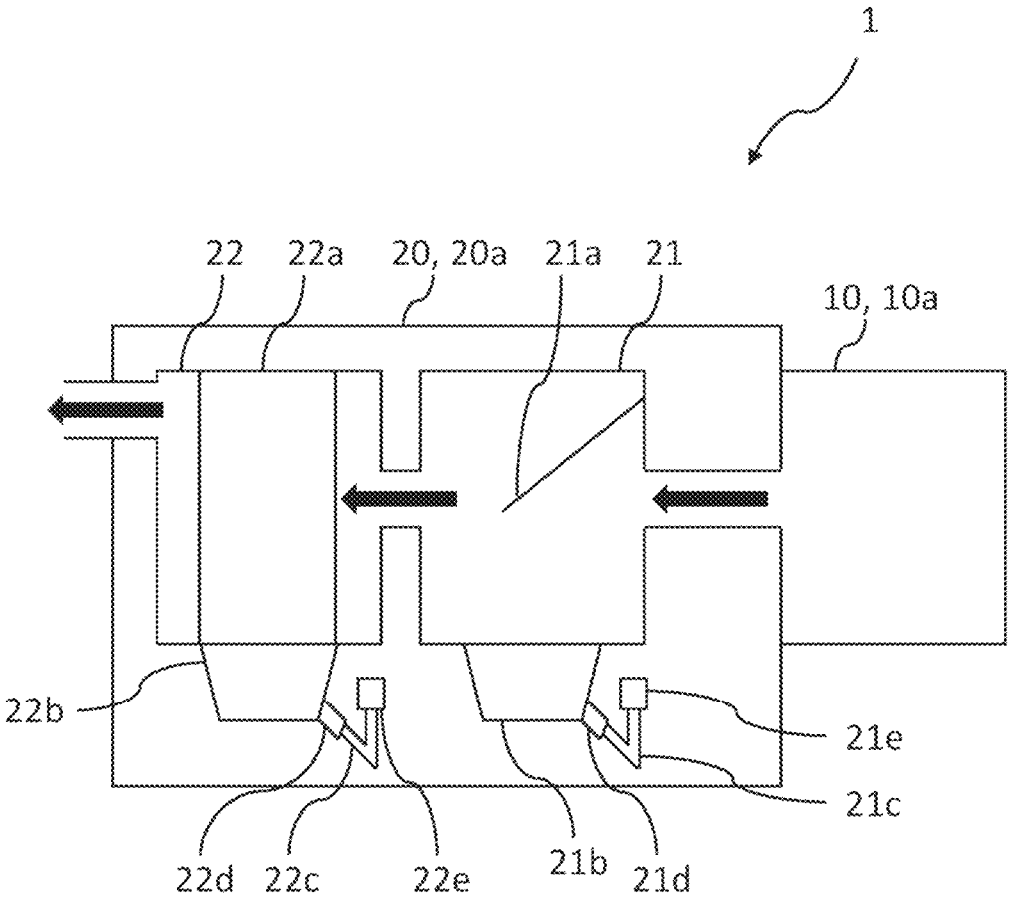
1
22
22a
20, 20a
21a
21
10, 10a
22b
21e
21c
22d
22c
22e
21b
21d

LIQUID SEPARATION DEVICE FOR A COMPRESSOR SYSTEM AND COMPRESSOR SYSTEM HAVING SUCH A LIQUID SEPARATION DEVICE

CROSS REFERENCE AND PRIORITY CLAIM

This patent application is a U.S. National Phase of International Patent Application No. PCT/EP2023/060367 filed Apr. 20, 2023, which claims priority to German Patent Application No. 10 2022 204 354.5, the disclosure of which being incorporated herein by reference in their entireties.

FIELD

Disclosed embodiments relate to a liquid separation device for a compressor system and to a compressor system having such a liquid separation device.

BACKGROUND

In oil-lubricated compressors such as oil-lubricated screw compressors, the oil that is used for lubrication and cooling is separated off, downstream of the compression operation, by suitable oil separation devices so as not to be introduced into downstream compressed-air systems. The oil that is separated off is subsequently fed back to the compressor, for example to the screw block in the case of oil-lubricated screw compressors.

In configurations of such a compressor system that are known from the current prior art, in oil-lubricated screw compressors, the compressed oil-air volume flow impinges on a coalescence filter, at the clean side of which the separated-off oil is suctioned away to the injection point on the screw block by way of the pressure gradient. Here, the oil separator forms an integral part of the compressor housing, and is installed directly therein. The recirculation to the screw block takes place via an external recirculation line that must be routed around the compressor housing. This external recirculation line not only requires a corresponding amount of structural space but must also be uninstalled during maintenance.

To prevent oil from running back into the coalescence filter when the compressor is shut down, a check valve is arranged in the recirculation line. Furthermore, an additional nozzle must be installed into the recirculation line in order to limit the air losses of the compressor, because predominantly air and only relatively low quantities of oil are situated at the clean side of the coalescence filter. Since the check valve and the nozzle are arranged in the external recirculation line, the check valve and the nozzle are exposed to corresponding ambient temperatures, such that, for example in the presence of low temperatures, there is the risk of freezing of the check valve and/or of the nozzle.

Furthermore, the suctioning of the oil at the clean-air side of the coalescence filter must in this case be implemented via an additional riser pipe. This arrangement gives rise to the risk of a permanent air leakage flow. Furthermore, residual oil quantities may remain below the immersion pipe, and may be introduced into the compressed-air system.

SUMMARY

In view of these conventional deficiencies, the disclosed embodiments provide a liquid separation device, which is improved in relation to the prior art, in particular with regard to a recirculation of liquid with the least possible losses, at the lowest possible cost, and with the greatest possible reliability.

BRIEF DESCRIPTION OF FIGURES

Disclosed embodiments are described below with the aid of the appended drawing.

In the drawing, FIG. 1 is a schematic illustration of an exemplary embodiment of a compressor system.

DETAILED DESCRIPTION

According to disclosed embodiments, a liquid separation device for a compressor system has: at least one coarse separation unit, which has at least one coarse separator and one liquid removal device; at least one fine separation unit, which has at least one fine separator and one liquid removal device; and at least one liquid removal channel, which discharges a liquid from the respective liquid removal devices. Here, the at least one liquid removal channel is formed in the liquid separation device.

The liquid separation device serves for separating a liquid from a liquid-gas volume flow from the compressor system. For example, the liquid separation device, which is positioned downstream of an oil-lubricated compressor, such as an oil-lubricated screw compressor, in the volume flow direction, may separate an oil from an oil-air volume flow. In such a case, the liquid separation device is an oil separation device that separates the oil from the compressed air. It is however alternatively also possible for other liquids, which serve for example for cooling and/or lubricating the compressor, to be separated off. It is also possible for a gas other than air to be compressed by the compressor.

Here, the liquid separation device is designed as a multi-stage liquid separation device that comprises at least one coarse separation unit and one fine separation unit, that is to say at least two stages. By way of the multi-stage design of the liquid separation device, it is for example possible for the separation efficiency to be increased. Likewise, the multi-stage design can have a positive effect on the service life of the individual separators that are used, in particular of fine separators.

A baffle plate, for example, may be used as a coarse separator in the coarse separation unit, onto which baffle plate the liquid-gas volume flow that is introduced into the coarse separation unit is initially directed at a relatively high velocity. Other embodiments of coarse separators are for example cyclone separators or knitted fabrics, for example knitted wire fabrics. The liquid-gas volume flow from which liquid has then already been separated in the coarse separation unit may then be directed onward into the fine separation unit. The fine separation unit has for example a coalescence filter as a fine separator, with liquid in turn being separated off on the outlet side, with respect to the liquid-gas volume flow, of the coalescence filter. The coarse separation unit and the fine separation unit in the context of a multi-stage separation however need not necessarily differ in terms of the nature of the respective coarse and fine separators. For example, a multi-stage separation may also involve structurally identical or at least structurally similar separation units, wherein the term "coarse separation unit" then refers to the fact that the quantities of liquid contained in the liquid-gas volume flow are greater there than at the fine separation unit. The separation units are, thus, passed through in series, wherein the fraction of the liquid quantity in the liquid-gas volume flow decreases sequentially, that is to say from the coarse separation unit to the fine separation unit.

In each case at least one liquid removal device is provided both in the coarse separation unit and in the fine separation unit and is arranged in a dripping direction, in relation to the particular separator, for the purposes of collecting the liquid that has been separated off.

To discharge the liquid that has been collected in each liquid removal device, at least one liquid removal channel is provided which extends from the particular liquid removal device in at least one first discharging direction. The first discharging direction may for example be directed downward in the direction of gravitational force in order to be able to initially reliably discharge the liquid under the action of gravitational force. The further course of each liquid removal channel may then differ from the first discharging direction. The at least one liquid removal channel may be designed as a recirculation channel that recirculates the separated-off liquid into a liquid reservoir for further use and/or treatment. For example, the separated-off oil may be fed via the recirculation channel back to a screw block of an oil-lubricated screw compressor.

Here, the at least one liquid removal channel is formed in the liquid separation device such that the liquid is conducted within the liquid separation device. Since it is, thus, possible for external liquid lines to be omitted at least in the region of the liquid separation device, a more compact design is made possible by way of internal liquid guidance. The at least one liquid removal channel is in this case also protected against external influences by the liquid separation device. It is likewise possible in this way for components that are arranged in the at least one liquid removal channel, such as a backflow prevention device and/or nozzle described further below, to be protected, for example against freezing. Furthermore, the effort involved in maintenance can be reduced, because no external lines, or fewer external lines, have to be uninstalled prior to the maintenance being carried out.

In one development, the at least one liquid removal channel is formed by a housing of the liquid separation device.

Accordingly, the at least one liquid removal channel may be jointly formed directly during the production of the housing of the liquid separation device. For example, the at least one liquid removal channel may be allowed for during the production of the housing of the liquid separation device as a casting. Alternatively or in addition, the at least one liquid removal channel may be formed by bores.

Alternatively or in addition, it is also possible for at least portions of the at least one liquid removal channel to be formed in the liquid separation device by at least one separate liquid removal channel line.

In one development, the at least one liquid removal channel is at least designed to have two channel portions, of which at least one channel portion is fluidically connected to the liquid removal device of the coarse separation unit and the at least one other channel portion is fluidically connected to the liquid removal device of the fine separation unit.

In such a development, the separated-off liquids from the coarse separation unit and from the fine separation unit are merged, via the channel portions, in one liquid removal channel.

Alternatively, the liquid separation device has at least two liquid removal channels, of which at least one liquid removal channel is fluidically connected to the liquid removal device of the coarse separation unit and the at least one other liquid removal channel is fluidically connected to the liquid removal device of the fine separation unit.

Accordingly, in each case one separate liquid removal channel is provided for the coarse separation unit and for the fine separation unit.

In particular, in one advantageous development, at least one backflow prevention device is arranged in each of the at least two channel portions or in each of the at least two liquid removal channels. Here, the backflow prevention device is configured to prevent a backflow from the at least two channel portions or the at least two liquid channels into the liquid removal device respectively connected thereto.

The backflow prevention device may for example be designed as a check valve.

In one refinement, the at least one backflow prevention device is arranged in each of the at least two channel portions or in each of the at least two liquid removal channels. Here, the backflow prevention device that can be assigned to one of the at least two channel portions or to one of the at least two liquid removal channels has a different response behavior than the backflow prevention device that can be assigned to the other of the at least two channel portions or to the other of the at least two liquid removal channels.

For example, different pressure conditions may prevail in each case in the coarse separation unit and in the fine separation unit. Through the use of at least one backflow prevention device in the liquid removal channels or channel portions that can be assigned in each case to the liquid removal device of the coarse separation unit and to the liquid removal device of the fine separation unit, the corresponding backflow prevention device can be adapted to the respectively prevailing pressure conditions. Alternatively, the respective backflow prevention devices of the coarse separation unit and of the fine separation unit, such as corresponding check valves, may also be of identical design. In this way, the number of different components to be installed, and the risk of incorrect installation, can be reduced.

In one development, at least one nozzle is arranged in the at least one liquid removal channel or is formed at least in part by the liquid channel.

Since it may be the case that not only the separated-off liquid but also gas can be discharged from the particular separation unit via the at least one liquid removal channel, corresponding gas losses and, thus, a decrease in efficiency of the compressor system can occur. The liquid or liquid-gas volume flow that potentially still contains the gas can be throttled using the nozzle, such that the gas losses can be reduced. This relates in particular to the liquid removal channel or channel portion that leads away from the liquid removal device of the fine separation unit because, here, only relatively low quantities of liquid in relation to the gas are separated off.

The nozzle may be inserted as a separate component into the at least one liquid removal channel. Alternatively or in addition, the cross section of the at least one liquid channel may also be adapted at least in certain portions such that corresponding throttling is implemented by way of such a portion. This nozzle or nozzle function is, thus, implemented directly by way of the at least one liquid removal channel.

In particular, in one advantageous development, the at least one nozzle is arranged in each of the at least two channel portions or in each of the at least two liquid removal channels, as described above. Here, the nozzle that can be assigned to one of the at least two channel portions or to one of the at least two liquid removal channels has a different cross section than the nozzle that can be assigned to the other of the at least two channel portions or to the other of the at least two liquid removal channels.

Similarly to the advantage of the use of at least one backflow prevention device in the liquid removal channels or channel portions that can be assigned in each case to the coarse separation unit and to the fine separation unit, similarly assigned nozzles make it possible to allow for different pressure conditions in the coarse separation unit and in the fine separation unit. In other words, the respective nozzles can be adapted to the prevailing pressure conditions.

If at least one backflow prevention device and at least one nozzle are used in a liquid removal channel or channel portion, the backflow prevention device is optionally arranged upstream of the nozzle in relation to the discharging direction of the liquid. In particular, the at least one backflow prevention device is provided in the vicinity of the liquid removal device that can be assigned to the backflow prevention device in each case.

In one development, the backflow prevention device and/or the nozzle is configured such that it can be screwed into the at least one liquid removal channel.

The backflow prevention device and/or the nozzle can, thus, be easily and reliably installed in the at least one liquid removal channel. Furthermore, a straightforward exchange is, thus, made possible, for example in the event of a failure or for the purposes of a change of characteristics.

Altogether, the above-described arrangement or design of each backflow prevention device and/or nozzle allows reliable and simple integration into the at least one liquid removal channel. Furthermore, it is possible for each of the separation units to be reliably cleared by suction with different pressure levels. Through the use of the respective backflow prevention devices and/or nozzles for the coarse separation unit and the fine separation unit, it is for example possible for a bypassing of the coarse separation unit and, thus, an introduction of liquid therefrom to the clean side of the fine separator to be prevented or at least reduced.

In one development, the backflow prevention device and the nozzle for each separation unit are formed by a common throughflow control device, in particular by a common throughflow control element.

The throughflow control device may correspondingly be designed as a preassembled unit that has both the backflow prevention device and the nozzle, each as individual components. It is then possible, for example, for distances between the backflow prevention device and the nozzle to be adjusted and tested in advance in the preassembled unit. Individual installation, with testing in each case as necessary, can furthermore be dispensed with, which can reduce the effort involved in installation. The throughflow control device may however also have a common throughflow control element or be designed as such a throughflow control element, which implements the functionalities of the backflow prevention device and of the nozzle in one common component. The backflow prevention device may accordingly be formed integrally with the nozzle in the throughflow control element.

In one development, when the liquid separation device is installed as intended for use, the at least one liquid removal device of the coarse separation unit and/or the at least one liquid removal device of the fine separation unit is arranged below the respectively associated separator, in particular in a flow-calmed region of the particular separation unit.

In other words, the at least one liquid removal device of the coarse separation unit and/or the at least one liquid removal device of the fine separation unit is arranged in the particular separation unit such that the liquid that is separated off at the particular separator drips or flows directly into the particular liquid removal device. It is, thus, possible to prevent at least the liquid that has been separated off at the particular separator from collecting at locations from which it cannot be discharged.

By virtue of the at least one liquid removal device of the coarse separation unit and/or the at least one liquid removal device of the fine separation unit being arranged in a flow-calmed region of the particular separation unit, it is furthermore possible to avoid a situation in which oil is entrained by the air flow.

In one development, the at least one liquid removal device of the coarse separation unit and/or the at least one liquid removal device of the fine separation unit has a liquid outlet to the at least one liquid removal channel, which liquid outlet is situated at a lowest point of the at least one liquid removal device of the coarse separation unit, and/or of the at least one liquid removal device of the fine separation unit, when the liquid separation device is installed as intended for use.

The separated-off liquid is, thus, suctioned away from the lowest point of the at least one liquid removal device of the particular separation unit. Riser pipes can, thus, be omitted. This increases reliability during maintenance, because, for example, bending of the riser line as a result of a collision with another tool can, thus, be ruled out. Since riser lines are commonly of geometrically pointed design, the risk of injury can also be reduced through the absence of a riser line. Efficiency can furthermore be increased, because it is possible to avoid enduring states in which only air is drawn in once the oil level falls below the lower edge of the suctioning device.

Furthermore, the separated-off liquid can be suctioned away completely, such that an introduction of liquid into other system regions can be avoided.

In one development, the at least one liquid removal device of the coarse separation unit and/or the at least one liquid removal device of the fine separation unit is formed as a releasable cover for fastening to the housing of the liquid separation device.

Accordingly, it is for example possible for the at least one liquid removal device of the coarse separation unit and/or the at least one liquid removal device of the fine separation unit to be easily removed for maintenance purposes and in order to provide corresponding access to the coarse separation unit and/or fine separation unit, without the need for recirculation lines to be uninstalled beforehand. Since the liquid removal channels are formed adjacent to the particular liquid removal device through the housing of the liquid separation device, no further bypasses have to be taken into consideration when dismounting the particular cover. Here, the particular cover may for example be screwed into the housing, screwed onto the housing, or fastenable to or in the housing in some other interlocking and/or frictional manner. The connection of the liquid outlet out of the cover, thus, transitions directly into the liquid removal channel of the housing of the liquid separation device, such that the liquid recirculation line is severed when the cover is uninstalled, and the liquid recirculation line is reconnected when the cover is installed again.

To ensure that the particular liquid outlet of the particular cover overlaps the respectively assignable liquid channel, an installation end position may be provided for example by virtue of the cover being screwed against a stop, by a corresponding pattern of holes, or by markings, which are to be brought into alignment, on the cover and on the housing.

For fluidic sealing between the cover, but also in principle the liquid removal device or the liquid outlet, and the particular liquid removal channel, a seal such as an O-ring may be arranged at the liquid outlet and/or at the liquid removal channel facing the liquid outlet, which seal fluidically seals off the region between the liquid outlet and the liquid removal channel. Leaks can correspondingly be prevented.

In one development, the at least one liquid removal channel is formed as a branch line or ring line.

The branch line can be easily implemented by a bore, and makes it possible to realize short path lengths. Alternatively, the at least one liquid removal channel may be designed as a ring line, for example in order to bypass further path lengths. The at least one liquid removal channel may however also be made up of branch line and ring line portions, and optionally further line portions of other form.

Disclosed embodiments provide a compressor system that has a compressor and an above-described liquid separation device. Here, the liquid separation device is arranged outside a housing of the compressor.

The liquid separation device is accordingly an external liquid separation device with respect to the compressor. The liquid separation device consequently has its own, external housing, into which the at least one liquid removal channel is integrated. The recirculation of liquid from the respective separation units back to the compressor or to some other discharge location, thus, takes place via the at least one liquid removal channel in the interior of the housing of the liquid removal device. Here, the at least one liquid removal channel is formed in particular by the housing wall.

In one development, a configuration is provided in which the housing of the compressor adjoins the housing of the liquid separation device. In particular, the at least one liquid removal channel adjoins a suction channel of the compressor.

The outlet of the at least one liquid removal channel may, thus, be connected directly to a corresponding inlet of the compressor, without the need for further external lines to be provided for this purpose. Alternatively, owing to the spatial proximity of the liquid separation device to the compressor, the distance from the housing of the liquid separation device to the housing of the compressor can be bridged by a very short recirculation line. This can make the compressor more compact, and reduce the effort involved in maintenance owing to a reduction of the number of components. It is also possible for further protective measures for external lines to be omitted, or reduced to a small number of lines.

The features described in the above description of the fluid separation device are equally applicable to the compressor system. Likewise, features described with regard to the compressor system are transferable to the fluid separation device, if the features have not already been described with regard thereto.

Disclosed embodiments provide a rail vehicle having an above-described fluid separation device and/or an above-described compressor system.

The fluid separation device and the compressor system make it possible to achieve low-loss, inexpensive and reliable liquid recirculation, which is reliable specifically even in demanding usage situations in rail vehicles. The required high availability of rail vehicles is furthermore promoted by the increased ease of maintenance.

The features described in the above description of the fluid separation device and of the compressor system are equally applicable to the rail vehicle. Likewise, features described with regard to the rail vehicle are transferable to the fluid separation device and to the compressor system, if the features have not already been described with regard to these.

FIG. 1 is a schematic illustration of an exemplary embodiment of a compressor system 1. The compressor system 1 comprises a compressor 10 having a housing 10*a* and having a liquid separation device 20 having a housing 20*a*. The housing 10*a* of the compressor directly adjoins the housing 20*a* of the liquid separation device 20. In the present configuration, the compressor system 1 may also be referred to as a compressor system having a compressor and having an external liquid separation device. In the exemplary embodiment, the compressor 10 is an oil-lubricated screw compressor for generating compressed air. Accordingly, the liquid separation device 20 is in this case an oil separation device. In alternative embodiments, the medium that is to be compressed may also be a gas other than air, and the liquid is not restricted to oil for lubrication and/or cooling purposes.

The liquid separation device 20 comprises a coarse separation unit 21 having a coarse separator 21*a* and comprises a fine separation unit 22 having a fine separator 22*a*. By way of example, the coarse separator 21*a* is in this case designed as a baffle plate, and the fine separator 22*a* is designed as a coalescence filter. In each of the separation units 21, 22, a liquid removal device 21*b*, 22*b* is arranged in the dripping direction of the separated-off liquid, in this case below each separator 21*a*, 22*a*. A liquid removal channel 21*c*, 22*c* extends in each case from the lowest point, in the dripping direction, of the liquid removal device 21*b* of the coarse separation unit 21 and also of the liquid removal device 22*b* of the fine separation unit 22. The liquid removal channel 21*c* of the coarse separation unit 21 discharges separated-off liquid that has collected in the liquid removal device 21*b* of the coarse separation unit 21, in order to make the liquid available to the compressor 10 again. For the fine separation unit 22, this takes place analogously via the liquid removal channel 22*c* of the fine separation unit 22. The separated-off liquid is collected and discharged in each case in a flow-calmed region, so as to avoid a situation in which the liquid that has already been collected is entrained by the flow in the particular separation unit 21, 22. The respective liquid removal devices 21*b* and 22*b* are formed here as the cover of the particular separation unit 21, 22, the covers being releasably fastened to the housing 20*a*. Each connection can be released for maintenance purposes. Since the liquid outlet of each of the liquid removal devices 21*b* and 22*b* directly adjoins the respective liquid removal channels 21*c* and 22*c* formed in the housing 20*a*, the respective separation units 21, 22 can be opened without uninstalling further bypass lines.

The liquid removal channel 21*c* of the coarse separation unit 21 has a check valve 21*d* as a backflow prevention device at its end facing the liquid removal device 21*b*. The check valve 21*d* prevents liquid from flowing from the liquid removal channel 21*c* back into the liquid removal device 21*b*. Furthermore, a nozzle 21*e* is arranged in the liquid removal channel 21*c* further downstream of the liquid removal device 21*b*. By the nozzle 21*e*, the liquid or liquid-gas volume flow that potentially still contains the gas can be throttled, such that the gas losses can be reduced. The liquid removal channel 21*c* is in this case formed directly in the housing 20*a* of the liquid separation device 20. It is formed here by virtue of the housing 20*a* being constructed as a corresponding casting. Furthermore, the design of the liquid removal channel 21*c* provides threaded portions in the region of the check valve 21*d* and of the nozzle 21*e*, such that the check valve 21*d* and the nozzle 21*e* can be screwed into the liquid removal channel 21*c*. Further downstream of the nozzle 21*e*, the separated-off liquid is fed via a further portion of the liquid removal channel 21*c* (not shown) directly back to the compressor 10, in this case to a screw block of the screw compressor. The recirculation takes place within the housing 10*a*, 20*a*, such that further external lines can be omitted.

The construction of the liquid removal channel 22*c* of the fine separation unit and the arrangement of a check valve 22*d* as a backflow prevention device and of a nozzle 22*e* for throttling purposes are implemented analogously to the statements made above with regard to the liquid removal channel 21*c* of the coarse separation unit 21. However, since different pressure levels prevail in the coarse separation unit 21 and in the fine separation unit 22, which give rise to different pressure conditions when the separated-off liquid is suctioned out of the particular liquid removal device 21*b*, 22*b* via the respective liquid removal channels 21*c*, 22*c*, the respective check valves 21*d*, 22*d* and nozzles 21*e*, 22*e* differ from one another. In other words, the check valve 21*d* and the nozzle 21*e* that are assigned to the coarse separation unit 21 are adapted to the pressure level prevailing in the coarse separation unit 21 and to the resulting pressure condition. Conversely, the check valve 22*d* and the nozzle 22*e* that are assigned to the fine separation unit 22 are adapted to the pressure level prevailing in the fine separation unit 22 and to the resulting pressure condition.

During the operation of the compressor system 1, with regard to the oil-lubricated screw compressor as compressor 10, the compressed oil-air volume flow, indicated in FIG. 1 by the black arrows, is introduced into the coarse separation unit 21. There, the compressed oil-air volume flow impinges on the baffle plate as coarse separator 21*a*, such that a first proportion of the oil is separated from the oil-air volume flow at the coarse separator 21*a* and drips into the liquid removal device 21*b* situated therebelow. The oil that is collected in the liquid removal device 21*b* of the coarse separation unit 21 is suctioned away through the liquid removal channel 21*c* of the coarse separation unit 21 via the check valve 21*d* arranged in the liquid removal channel 21*c* and via the nozzle 21*e* that is likewise arranged in the liquid removal channel, and the oil is fed back to the screw block of the compressor 10.

The compressed oil-air volume flow from which a proportion of the oil has already been separated off in the coarse separation unit 21 then flows from the coarse separation unit 21 into the fine separation unit 22. In the fine separation unit 22, the compressed oil-air volume flow passes through the fine separator 22*a*, whereby, in turn, oil is separated off and is collected in the liquid removal device 22*b* of the fine separation unit 22. Analogously to the suctioning of the oil out of the coarse separation unit 21, it is also the case in the fine separation unit 22 that the separated-off oil is suctioned away and recirculated through the liquid removal channel 22*c* of the fine separation unit 22, via the check valve 22*d* arranged in the liquid removal channel 22*c* and via the nozzle 22*e* that is likewise arranged in the liquid removal channel, into the screw block of the compressor 10.

In the exemplary embodiment, the liquid removal channel 22*c* of the fine separation unit 22 and liquid removal channel 21*c* of the coarse separation unit 21 are merged within the housing 20*a* of the liquid separation device 20 to form a common liquid removal channel (not shown) in order to feed the oil that has been suctioned away in each case to the screw block of the compressor 10 via the common liquid removal channel. In alternative embodiments, the liquid removal channel 22*c* of the fine separation unit 22 and liquid removal channel 21*c* of the coarse separation unit 21 may however also be routed separately in the housing 20*a* of the liquid separation device 20, in order to open into a common liquid removal channel for the first time in the housing 10*a* of the compressor, or in order to each be guided to a separate inlet into the screw block of the compressor 10.

The invention is not restricted to the embodiment described. In particular, features described with regard to the embodiment, other described developments and refinements of the invention may be combined with one another provided that they are not mutually exclusive.

LIST OF REFERENCE SIGNS

1 Compressor system
10 Compressor
10*a* Housing (compressor)
20 Liquid separation device
20*a* Housing (liquid separation device)
21 Coarse separation unit
21*a* Coarse separator
21*b* Liquid removal device (coarse separation unit)
21*c* Liquid removal channel (coarse separation unit)
21*d* Check valve (coarse separation unit; backflow prevention device)
21*e* Nozzle (coarse separation unit)
22 Fine separation unit
22*a* Fine separator
22*b* Liquid removal device (fine separation unit)
22*c* Liquid removal channel (fine separation unit)
22*d* Check valve (fine separation unit; backflow prevention device)
22*e* Nozzle (fine separation unit)

The invention claimed is:

1. A liquid separation device for a compressor system, the liquid separation device comprising:
at least one coarse separation unit, which has at least one coarse separator and one liquid removal device,
at least one fine separation unit, which has at least one fine separator and one liquid removal device, and
at least one liquid removal channel, which discharges a liquid from the respective liquid removal devices,
wherein the at least one liquid removal channel is formed in the liquid separation device,
wherein the at least one liquid removal channel is formed by a housing of the liquid separation device, and
wherein at least one nozzle is arranged in the at least one liquid removal channel or is formed at least in part by the liquid channel.

2. The liquid separation device of claim 1, wherein:
the at least one liquid removal channel has at least two channel portions, of which at least one channel portion is fluidically connected to the liquid removal device of the coarse separation unit and the at least one other channel portion is fluidically connected to the liquid removal device of the fine separation unit, or
the liquid separation device has at least two liquid removal channels, of which at least one liquid removal channel is fluidically connected to the liquid removal device of the coarse separation unit and the at least one other liquid removal channel is fluidically connected to the liquid removal device of the fine separation unit.

3. The liquid separation device of claim 2, wherein at least one backflow prevention device is arranged in each of the at least two channel portions or in each of the at least two liquid removal channels, and wherein the backflow prevention device is configured to prevent a backflow from the at least two channel portions or the at least two liquid channels into the liquid removal device respectively connected thereto.

4. The liquid separation device of claim 3, wherein the at least one backflow prevention device is arranged in each of the at least two channel portions or in each of the at least two liquid removal channels, and wherein the backflow prevention device that can be assigned to one of the at least two channel portions or to one of the at least two liquid removal channels has a different response behavior than the backflow prevention device that can be assigned to the other of the at least two channel portions or to the other of the at least two liquid removal channels.

5. The liquid separation device of claim 4, wherein the at least one nozzle is arranged in each of the at least two channel portions or in each of the at least two liquid removal channels as claimed in claim 3, and wherein the nozzle that can be assigned to one of the at least two channel portions or to one of the at least two liquid removal channels has a different cross section than the nozzle that can be assigned to the other of the at least two channel portions or to the other of the at least two liquid removal channels.

6. The liquid separation device of claim 3, wherein the backflow prevention device and/or the nozzle can be screwed into the at least one liquid removal channel.

7. The liquid separation device of claim 3, wherein the backflow prevention device and the nozzle are formed by a common throughflow control device.

8. The liquid separation device of claim 1, wherein, when the liquid separation device is installed, the at least one liquid removal device of the coarse separation unit and/or the at least one liquid removal device of the fine separation unit is arranged below the respectively associated separator in a flow-calmed region of the particular separation unit.

9. The liquid separation device of claim 1, wherein the at least one liquid removal device of the coarse separation unit and/or the at least one liquid removal device of the fine separation unit has a liquid outlet to the at least one liquid removal channel, which liquid outlet is situated at a lowest point of the at least one liquid removal device of the coarse separation unit, and/or of the at least one liquid removal device of the fine separation unit, when the liquid separation device is installed as intended for use.

10. The liquid separation device of claim 1, wherein the at least one liquid removal device of the coarse separation unit and/or the at least one liquid removal device of the fine separation unit is formed as a releasable cover for fastening to the housing of the liquid separation device.

11. The liquid separation device of claim 1, wherein the at least one liquid removal channel is formed as a branch line or ring line.

12. A compressor system comprising:

a compressor and a liquid separation device including at least one coarse separation unit, which has at least one coarse separator and one liquid removal device, at least one fine separation unit, which has at least one fine separator and one liquid removal device, and at least one liquid removal channel, which discharges a liquid from the respective liquid removal devices, wherein the at least one liquid removal channel is formed in the liquid separation device, wherein the at least one liquid removal channel is formed by a housing of the liquid separation device, and wherein at least one nozzle is arranged in the at least one liquid removal channel or is formed at least in part by the liquid channel wherein the liquid separation device is arranged outside a housing of the compressor.

13. The compressor system of claim 12, wherein the housing of the compressor adjoins the housing of the liquid separation device, and, the at least one liquid removal channel adjoins a suction channel of the compressor.

14. A rail vehicle comprising:

a compressor system that includes a compressor and a liquid separation device including at least one coarse separation unit, which has at least one coarse separator and one liquid removal device, at least one fine separation unit, which has at least one fine separator and one liquid removal device, and at least one liquid removal channel, which discharges a liquid from the respective liquid removal devices, wherein the at least one liquid removal channel is formed in the liquid separation device, wherein the at least one liquid removal channel is formed by a housing of the liquid separation device, and wherein at least one nozzle is arranged in the at least one liquid removal channel or is formed at least in part by the liquid channel, wherein the liquid separation device is arranged outside a housing of the compressor.

15. The compressor system of claim 12, wherein:

the at least one liquid removal channel has at least two channel portions, of which at least one channel portion is fluidically connected to the liquid removal device of the coarse separation unit and the at least one other channel portion is fluidically connected to the liquid removal device of the fine separation unit, or the liquid separation device has at least two liquid removal channels, of which at least one liquid removal channel is fluidically connected to the liquid removal device of the coarse separation unit and the at least one other liquid removal channel is fluidically connected to the liquid removal device of the fine separation unit.

16. The compressor system of claim 15, wherein at least one backflow prevention device is arranged in each of the at least two channel portions or in each of the at least two liquid removal channels, and wherein the backflow prevention device is configured to prevent a backflow from the at least two channel portions or the at least two liquid channels into the liquid removal device respectively connected thereto.

17. The rail vehicle of claim 14, wherein:

the at least one liquid removal channel has at least two channel portions, of which at least one channel portion is fluidically connected to the liquid removal device of the coarse separation unit and the at least one other channel portion is fluidically connected to the liquid removal device of the fine separation unit, or the liquid separation device has at least two liquid removal channels, of which at least one liquid removal channel is fluidically connected to the liquid removal device of the coarse separation unit and the at least one other liquid removal channel is fluidically connected to the liquid removal device of the fine separation unit.

18. The rail vehicle of claim 17, wherein at least one backflow prevention device is arranged in each of the at least two channel portions or in each of the at least two liquid removal channels, and wherein the backflow prevention device is configured to prevent a backflow from the at least two channel portions or the at least two liquid channels into the liquid removal device respectively connected thereto.

* * * * *